US011197095B2

(12) United States Patent
Welti et al.

(10) Patent No.: US 11,197,095 B2
(45) Date of Patent: Dec. 7, 2021

(54) ONE-CLICK MEASUREMENT FOR HEADPHONES

(71) Applicant: HARMAN INTERNATIONAL INDUSTRIES, INCORPORATED, Stamford, CT (US)

(72) Inventors: Todd S. Welti, Thousand Oaks, CA (US); Sean E. Olive, Oak Park, CA (US); Omid Khonsaripour, Northridge, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/755,057

(22) PCT Filed: Oct. 12, 2018

(86) PCT No.: PCT/US2018/055636
§ 371 (c)(1),
(2) Date: Apr. 9, 2020

(87) PCT Pub. No.: WO2019/075345
PCT Pub. Date: Apr. 18, 2019

(65) Prior Publication Data

US 2021/0195329 A1 Jun. 24, 2021

Related U.S. Application Data

(60) Provisional application No. 62/572,074, filed on Oct. 13, 2017.

(51) Int. Cl.

| | |
|---|---|
| ***H04R 3/12*** | (2006.01) |
| ***H04R 5/04*** | (2006.01) |
| ***H04R 29/00*** | (2006.01) |

(52) U.S. Cl.
CPC ..... *H04R 3/12* (2013.01); *H04R 5/04* (2013.01); *H04R 29/002* (2013.01)

(58) Field of Classification Search
CPC . H04R 1/10; H04R 1/28; H04R 5/033; H04R 25/00; H04R 5/00; H04R 1/20; H04R 5/04; H04R 2205/022; H04R 29/001; H04R 29/002; H04R 3/12; G06F 17/3074; H04S 3/004
See application file for complete search history.

(56) References Cited

U.S. PATENT DOCUMENTS

| | | | | |
|---|---|---|---|---|
| 2005/0195982 | A1* | 9/2005 | Olive | H04R 29/00 381/59 |
| 2007/0112563 | A1* | 5/2007 | Krantz | G10L 25/69 704/216 |
| 2011/0029111 | A1 | 2/2011 | Sabin et al. | |
| 2013/0003981 | A1 | 1/2013 | Lane | |
| 2013/0236023 | A1 | 9/2013 | Horbach | |
| 2015/0003649 | A1 | 1/2015 | Horbach | |
| 2016/0277860 | A1* | 9/2016 | Vesa | H04R 3/04 |
| 2016/0366518 | A1 | 12/2016 | Strogis et al. | |
| 2019/0087739 | A1* | 3/2019 | Olive | G06F 30/20 |

* cited by examiner

*Primary Examiner* — Yogeshkumar Patel
(74) *Attorney, Agent, or Firm* — Brooks Kushman P.C.

(57) ABSTRACT

A memory stores a linear model predicting a preference rating for in-ear headphones. A processor is programmed to generate a headphone response curve defining a frequency response of a headphone, apply the linear model to the headphone response curve to determine a preference rating, and provide the preference rating to predict overall sound quality of the in-ear headphone without listening tests.

20 Claims, 10 Drawing Sheets

900

1000

127.0.0.1

One_Click Sound Quality Calculation

Predicted Sound Quality Rating: - 38.5

Select a headphone to plot and calculate sound quality:

| Brand | Model | Type | Price | Date Tested | Location | Tester | Link |
|---|---|---|---|---|---|---|---|
| AKG | K3003i | IE | $899 | June 2 2015 | Northridge | Omid | https://ww... |
| Harman | Reference | IE | $300 | June 2 2016 | Northridge | Omid | |
| AKG | Y23 | IE | $60 | June 2 2016 | Northridge | Omid | |
| Polk Audio | AM5110-A | IE | $59.95 | June 2 2016 | Northridge | Omid | |

ONE-CLICK MEASUREMENT FOR HEADPHONES

CROSS-REFERENCE TO RELATED APPLICATION

This application is a U.S. national phase of PCT Application No. PCT/US2018/055636 filed on Oct. 12, 2018, which claims the benefit of U.S. provisional application Ser. No. 62/572,074 filed Oct. 13, 2017, the disclosures of which are hereby incorporated in their entirety by reference herein.

TECHNICAL FIELD

Aspects of the disclosure generally relate to one-click measurement of headphones.

SUMMARY

In one or more illustrative examples, a system for predicting listener preference ratings for headphones includes a memory storing a linear model predicting a preference rating for headphones and a processor. The processor is programmed to display a user interface for measurement of headphones; perform a sweep test of the headphone to create a headphone response curve defining a frequency response of the headphone responsive to selection a measure control of the user interface; and display a preference score for the headphone to the user interface computed using the linear model according to the sweep test.

In one or more illustrative examples, a method for predicting listener preference ratings for headphones includes displaying a user interface for measurement of headphones; receiving, via the user interface, information about a headphone to be tested; responsive to selection of a measure control of the user interface, performing a sweep test of the headphone to create a headphone response curve defining a frequency response of the headphone; and displaying test results for the headphone to the user interface, the test results including a preference score for the headphone computed using a linear model and the headphone response curve.

In one or more illustrative examples, a non-transitory computer-readable medium includes instructions that, when executed by a processor of a headphone measuring system, cause the headphone measuring system to display a user interface for measurement of headphones; responsive to selection of a measure control of the user interface, perform a sweep test of the headphone to create a headphone response curve defining a frequency response of the headphone; and display test results for the headphone to the user interface, the test results including a preference score for the headphone computed using a linear model and the headphone response curve, the linear model being developed using independent variables including mean error (ME) of the headphones response curve to the target response curve, standard deviation (SD) of error of the HREC, and absolute value of a slope (AS) of a logarithmic regression line of the HREC.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In many cases, measuring the acoustic performance of headphones requires relatively expensive equipment, and a highly skilled/trained engineer or technician in order to conduct accurate and valid measurements. It may also be difficult to interpret the meaning of headphone measurements in terms of their impact on the headphone's perceived sound quality. Typically, an operator will see deviations in the measured response from a reference, but visually interpreting their impact on sound quality is a difficult task and prone to error. Casual listening to the headphone may provide answers, but these types of tests require expert trained listeners. Another solution is to conduct controlled listening tests using trained listeners. This is an expensive and time-consuming exercise.

This disclosure describes a system that is referred to herein as the "one-click Headphone Measurement System." The system features a measurement system that is self-contained and portable. The system has a relatively low cost using commercially-available hardware, and is 110 to 240 volts compatible. The system is easy to operate (e.g., one-click operation), requiring no special skills or training from the operator. Results from the system are stored in a database and can be viewed via an internet or other networked system.

Custom software installed to the system automatically interprets the measurements using a proprietary statistical predictive model that calculates an error curve based on deviations in magnitude response from a preferred headphone target response. This error curve is analyzed and a sound quality rating is calculated on a 100-point scale. The predictive model was developed using machine learning to analyze objective and subjective measurements of a large number of headphones that were evaluated by trained and untrained listeners.

Figure 1:
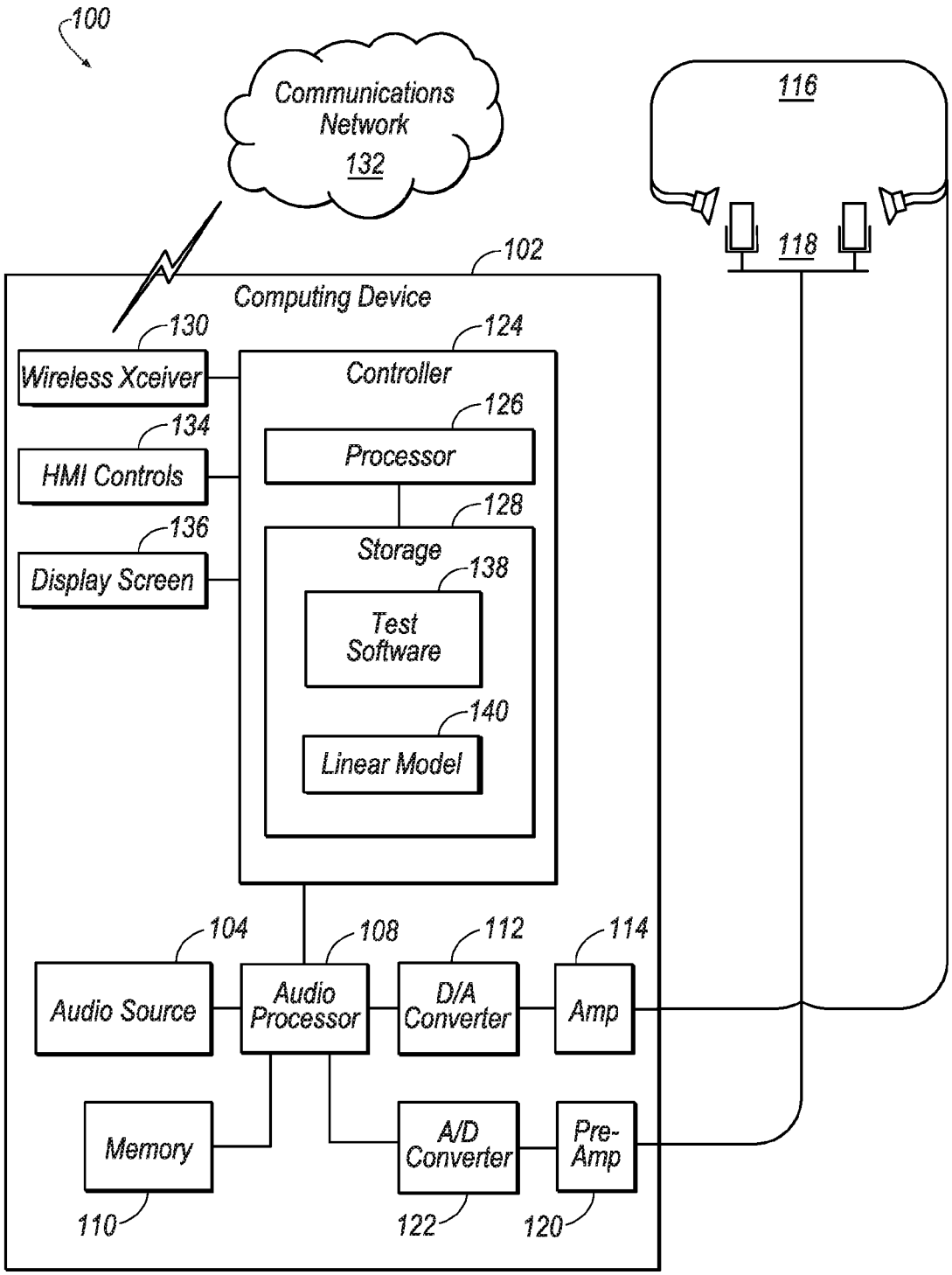
FIG. 1 illustrates an example system for a computing device configured to perform one-click virtual headphone listening tests.

FIG. 1 illustrates an example measurement system 100 for a computing device 102 configured to perform one-click virtual headphone listening tests. The computing device 102 selects audio via an audio source 104 or an audio input, and passes the audio to be processed to an audio processor 108. Audio output from the audio processor 108 may be passed through a digital to analog (D/A) converter 112 and an amplifier 114 for reproduction by a headphone under test 116. Sound from the headphone under test 116 is captured using microphones 118, and is fed into a preamplifier 120. The preamplifier 120 feeds an analog to digital (A/D) converter 122, which passes the input to the audio processor 108 for analysis. The computing device 102 also includes a controller 124 connected to the audio processor 108 and configured to manage the performance of the one-click headphone listening tests via one-click tester software 138. The controller 124 identifies audio to play back and a model of headphone to test, and directs the audio processor 108 to play back the test audio for headphone testing. The controller 124 also interfaces with a wireless transceiver 130 to facilitate communication over a communications network 132, to provide the results to a remote server. In many examples, the controller 124 is also connected to one or more human machine interface (HMI) controls 134 to receive user input, as well as a display screen 136 to provide visual output. It should be noted that the illustrated system 100 is merely an example, and more, fewer, and/or differently located elements may be used.

The audio source 104 may be a recording or generated signal that may be used in the headphone tests. In an example, the audio source 104 may include frequency sweeps to cover a frequency range of a device to be tested. In some examples, the audio source 104 may be analog instead of digital, and in such cases the system may further include an analog to digital (A/D) converter that converts signals from an analog format into a digital format for further processing by the audio processor 108.

While only one is shown, one or more audio processors 108 may be included in the computing device 102. The audio processors 108 may be one or more computing devices capable of processing audio and/or video signals, such as a computer processor, microprocessor, a digital signal processor, or any other device, series of devices, or other mechanisms capable of performing logical operations. The audio processors 108 may operate in association with a memory 110 to execute instructions stored in the memory 110. The instructions may be in the form of software, firmware, computer code, or some combination thereof, and when executed by the audio processors 108 may provide for headphone frequency response measurement functionality as well as for linear model 140 prediction of user preference to predict sound quality without listening tests. The memory 110 may be any form of one or more data storage devices, such as volatile memory, non-volatile memory, electronic memory, magnetic memory, optical memory, or any other form of data storage device. In addition to instructions, operational parameters and data may also be stored in the memory 110, such as a phonemic vocabulary for the creation of speed from textual data.

The D/A converter 112 receives the digital output signal from the audio processor 108 and converts it from a digital format to an output signal in an analog format. The output signal may then be made available for use by the amplifier 114 or other analog components for further processing.

The amplifier 114 may be any circuit or standalone device that receives audio input signals of relatively small magnitude, and outputs similar audio signals of relatively larger magnitude. Audio input signals may be received by the amplifier 114 and output on one or more connections to the headphones under test 116. The amplifier 114 may include capability to adjust volume, balance, and/or fade of the audio signals provided to the headphones under test 116. In still other examples, the headphones under test 116 may include the amplifier 114, such that the headphones under test 116 are self-powered.

The microphones 118 may be various devices used to capture the sound produced by the headphones under test 116. In one example, the microphones 118 may be connected to the headphones via a standard IEC 711 coupler. For instance, a first microphone 118 may receive audio output from a left earbud, and a second microphone 118 may receive audio output from a right earbud. The microphones 118 may provide signals indicative of the captured sound to the preamplifier 120. The preamplifier 120 may amplify and buffer the signal provided from the microphones 118, and may provide the resultant signal to the A/D converter 122, which in turn provides the digitized signal back to the audio processor 108 for analysis. It should be noted that the preamplifier 120 or other of these components may be external or internal to the computing device 102.

The controller 124 may include various types of computing apparatus in support of performance of the functions of the computing device 102 described herein. In an example, the controller 124 may include one or more processors 126 configured to execute computer instructions, and a storage medium 128 on which the computer-executable instructions and/or data may be maintained. A computer-readable storage medium (also referred to as a processor-readable medium or storage 128) includes any non-transitory (e.g., tangible) medium that participates in providing data (e.g., instructions) that may be read by a computer (e.g., by the processor(s) 126). In general, a processor 126 receives instructions and/or data, e.g., from the storage 128, etc., to a memory and executes the instructions using the data, thereby performing one or more processes, including one or more of the processes described herein. Computer-executable instructions may be compiled or interpreted from computer programs created using a variety of programming languages and/or technologies including, without limitation, and either alone or in combination, Java, C, C++, C#, Assembly, Fortran, Pascal, Visual Basic, Python, Java Script, Perl, PL/SQL, etc.

As shown, the controller 124 may include a wireless transceiver 130 or other network hardware configured to facilitate communication between the controller 124 and other networked devices over the communications network 132. As one possibility, the wireless transceiver 130 may be a cellular network transceiver configured to communicate data over a cellular telephone network. As another possibility, the wireless transceiver 130 may be a Wi-Fi transceiver configured to connect to a local-area wireless network to access the communications network 132.

The controller 124 may receive input from human-machine interface (HMI) controls 134 to provide for user interaction with computing device 102. For instance, the controller 124 may interface with a keyboard, one or more buttons, or other HMI controls 134 configured to invoke functions of the controller 124. The controller 124 may also drive or otherwise communicate with one or more displays 136 configured to provide visual output to users, e.g., by way of a video controller. In some cases, the display 136 may be a touch screen further configured to receive user touch input via the video controller, while in other cases the display 136 may be a display only, without touch input capabilities.

In an example, the display 136 may be utilized to present a screen of the test software 138. An example screen of the test software 138 is discussed below with respect to FIG. 5.

The test software 138 may be programmed to utilize a statistical model to predict preference ratings of the headphones 116 (e.g., IE, AE/OE, etc.), without requiring user input from listener tests. Using the model, the predicted preference ratings may eliminate the need to conduct time-consuming and expensive listening tests to validate headphone designs, which may save time and money. Moreover, using the model, objective performance targets can be created that establish consistent headphone design goals for each brand.

As mentioned in greater detail below, the test software 138 performs a frequency response test of the headphones 116. In an example, for a new headphone to be tested, the microphones 118 may be utilized to measure frequency response of the left and right channels of the headphones under test 116, e.g., from 20 Hz to 20 kHz in 48 log spaced points from 20 Hz to 20 kHz. This information may be recorded by the audio processor 108. The test software 138 may be programmed to receive the recorded frequency response information and calculate an average magnitude response of the left and right channels.

The test software 138 may be further programmed to calculate a headphone response error curve (HREC) based on a difference in response between the headphone 116 and a target headphone response curve. In many examples, the HREC is only calculated for frequencies between 20 Hz to 10 kHz, since above 12 kHz there are error variances in the ear simulators and ear canals of listeners related to anthropometric differences that are not included in HREC and the linear model 140 (discussed in more detail below).

Figure 2:
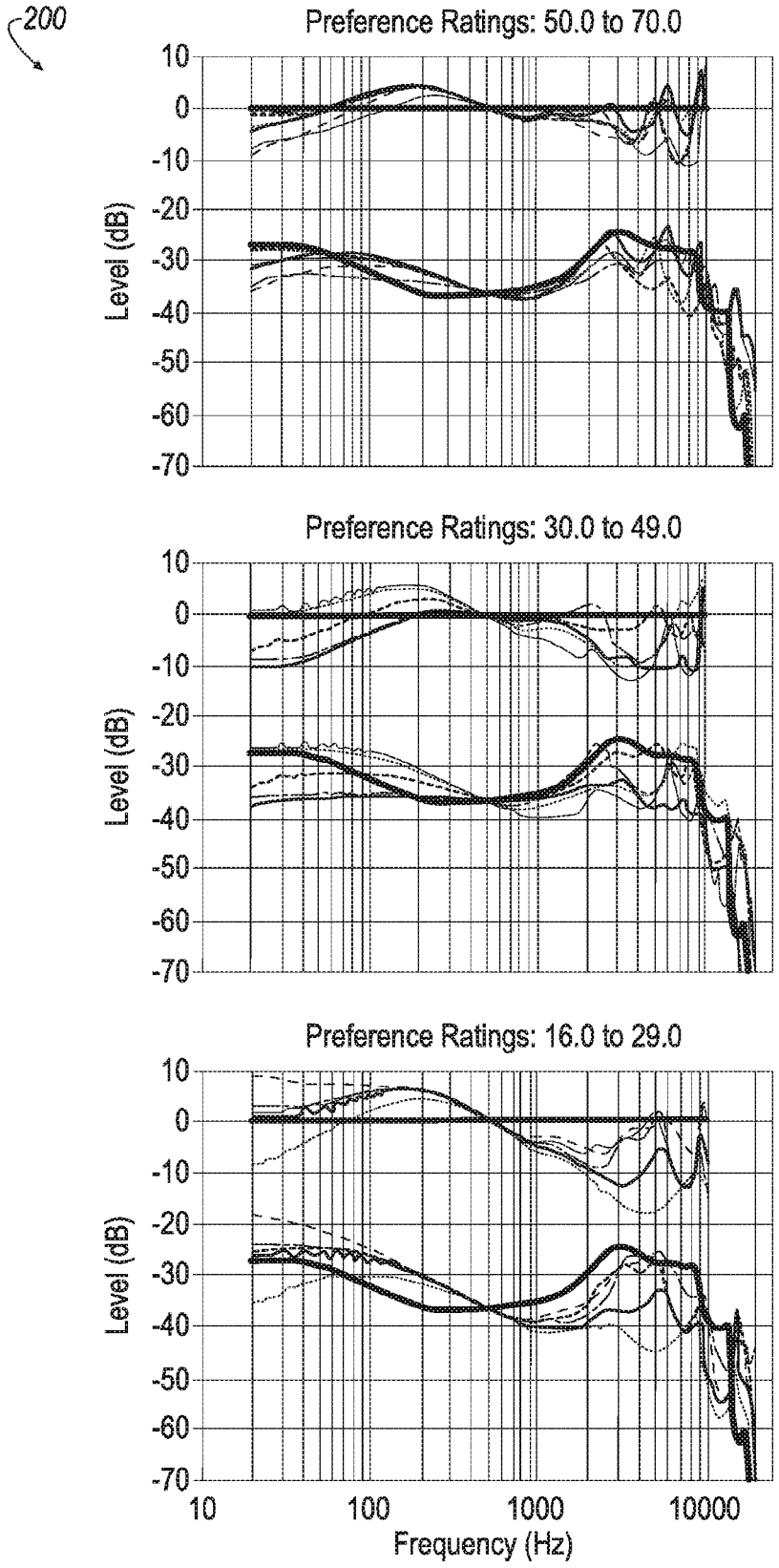
FIG. 2 illustrates an example of three graphs of headphone measurements in comparison to a target headphone response curve.

The target headphone response curve may be a response curve for a hypothetical headphone. The target headphone response curve may indicate a desired response curve for headphones generally. (An example target headphone response curve is shown in FIG. 2, discussed below.) In an example, the target headphone response curve may be found experimentally. In some cases, different target response curves may be used for IE headphones as opposed to around-the-ear (AE) headphones. For instance, the preferred target response for an IE headphone may be similar to the preferred AE target response, but with an additional 4 dB bass and some differences above 1 KHz. A possible reason for listeners preferring more bass in IE headphones is to compensate for increased physiological noise from the occlusion effect.

FIG. 2 illustrates an example 200 of three graphs of headphone measurements in comparison to a target headphone response curve. The first of the three graphs shows headphone measurements where the headphones received high preference ratings (50-70 points), the second of the graphs shows headphone measurements where the headphones received mediocre preference ratings (30-49 points), while the third of the graphs shows headphone measurements where the headphones received low preference ratings (16-29 points). In each graph, the HREC's are shown at the top of the graph with the magnitude responses of the headphones plotted below with a preferred IE headphone target response curve plotted as a thick black curve.

A trend can be seen from the graphs 200 that headphones receive lower preference ratings as their response deviates further away from the response of the target curve. Accordingly, the HREC may serve as a primary metric to explain and predict a preference rating for a headphone 116.

As described herein, a statistical model can be developed using a selection of independent variables derived from statistical measures of the error response curve of the headphones to be considered. Several independent variables may be considered as potential candidates for a model as being derived from the error response curve of the headphone 116. These may include different statistical measures of the errors including the mean error, the standard deviation of the error, and the slope of the error curve. As some further examples, the independent variables may include one or more of the bandwidth over which the errors occurred to possibly account for the frequency-dependent sensitivity and selectivity of human hearing, as well as possible frequency-dependent interactions between the headphones and spectra of the program material. In situations where there are limited significant program effects or interactions with headphones, it follows that such a situation would be unlikely to account for possible bandwidth effects.

As discussed herein, while other variables may be used, an example set of measures utilized in generation of the model 140 includes mean error, standard deviation of the error, and slope of the error curve. The model may further consider frequency range or bandwidth over which the errors occurred. The listener test software 138 may utilize a linear model 140 developed using these or other independent variables as discussed in detail herein. Also, as discussed herein, such a linear model 140 based on the mean error, standard deviation, and slope of the headphone's error response curve can accurately predict the headphone's preference rating with an error of 5.5% and a correlation coefficient of r=0.91. After some preliminary regression and principal component analysis of these different independent variables, the following three explanatory variables may be relatively useful for the predictive linear model 140 when applied to IE headphones:

$ME_{40Hz_10kHz}$—The mean error defined by the headphone response error curve calculated by the absolute value of the y-values from 40 Hz to 10 kHz as expressed in equation 1.

$$ME_{40\ Hz-10\ kHz} = \frac{\text{abs}(y1) + \text{abs}(y2) + \text{abs}(y3)}{n} \tag{1}$$

SD—The standard deviation of the error defined by the headphone error curve calculated from the y-values from 20 Hz to 10 kHz as defined in equation 2.

$$SD = \frac{\sqrt{\sum (y - y)^2}}{(n-1)} \tag{2}$$

AS—The absolute value of the slope of a logarithmic regression line that best fits the y and x values defined in the headphone error response curve from 20 Hz to 10 kHz.

$$AS = \sqrt{\frac{\sum (\ln(x) - \ln(\bar{x}))(y - y)}{\sum (\ln(x) - \ln(x)^2}} \tag{3}$$

Regarding the linear model 140 used to predict a preference rating of the headphones 116, the linear model 140 was developed using the three independent variables discussed in the previous section. The regression was performed using Partial Least Squares (PLS) due to the collinear nature of the independent variables. PLS reduces the independent variables to a set of uncorrelated principal components, and then performs least squares regression. PLS regression is appropriate when the predictors are highly collinear, and/or when there are more predictors than observations and ordinary least-squares regression either produces coefficients with high standard errors or fails completely.

After a reiterative process, a linear model 140 expressed in Equation 4 was found to produce the best goodness of fit (see Table 1 below) based on the Pearson correlation coefficient (r=0.91) and the lowest root mean squares error (MSE) of 5.5%. The latter represents an error of 5.5 points on the 100-point preference scale, and smaller than the error in the subjective preference ratings. Table 1 illustrates statistics regarding the goodness of fit for the linear model 140 utilizing the Equation 4.

$$\text{Pred. Preference}=68.685-(3.238*SD)-(4.473*AS)-(2.658*ME) \quad (4)$$

TABLE 1

The Goodness of Fit Statistics for the IE predictive linear model 140

| | |
|---|---|
| Observations | 32.000 |
| Sum of weights | 31.000 |
| DF | 29.000 |
| R | 0.91 |
| $R^2$ | 0.819 |
| Standard deviation | 5.691 |
| MSE | 30.301 |
| RMSE | 5.505 |

Similar techniques may be applied to AE/OE headphones. For AE/OE headphones, the same three variables defined in equations (1), (2), and (3) may be initially selected to provide different statistical measures of deviations in the error response curves. A linear model for AE/OE headphones may then be developed initially using these independent variables. A regression analysis may similarly be performed using Partial Least Squares (PLS) due to the collinear nature of the explanatory variables. After an iterative process, a linear model for AE/OE headphones was found that produces the best goodness of fit based on the Pearson correlation coefficient of r=0.86. The statistics for goodness of fit are summarized in Table 2 and the equation for the AE/OE model is defined in equation (5):

$$\text{Pred. Preference}=114.49-(12.62*SD)-(15.52*AS) \quad (5)$$

TABLE 2

The Goodness of Fit Statistics for the AE/OE predictive linear model 140

| | |
|---|---|
| Observations | 32.000 |
| Sum of weights | 31.000 |
| DF | 29.000 |
| R | 0.741 |
| $R^2$ | 0.861 |
| Standard deviation | 6.933 |
| MSE | 44.962 |
| RMSE | 6.705 |

The standardized coefficients for the variables in the model are weighted approximately equal: SD=−0.47, and AS=−0.434. Note that the model for AE/OE headphones only has two independent variables (i.e., SD and AS) since including the third variable ME added little information to explaining the variance in preference ratings, and reduced the quality of the model.

Figure 3:
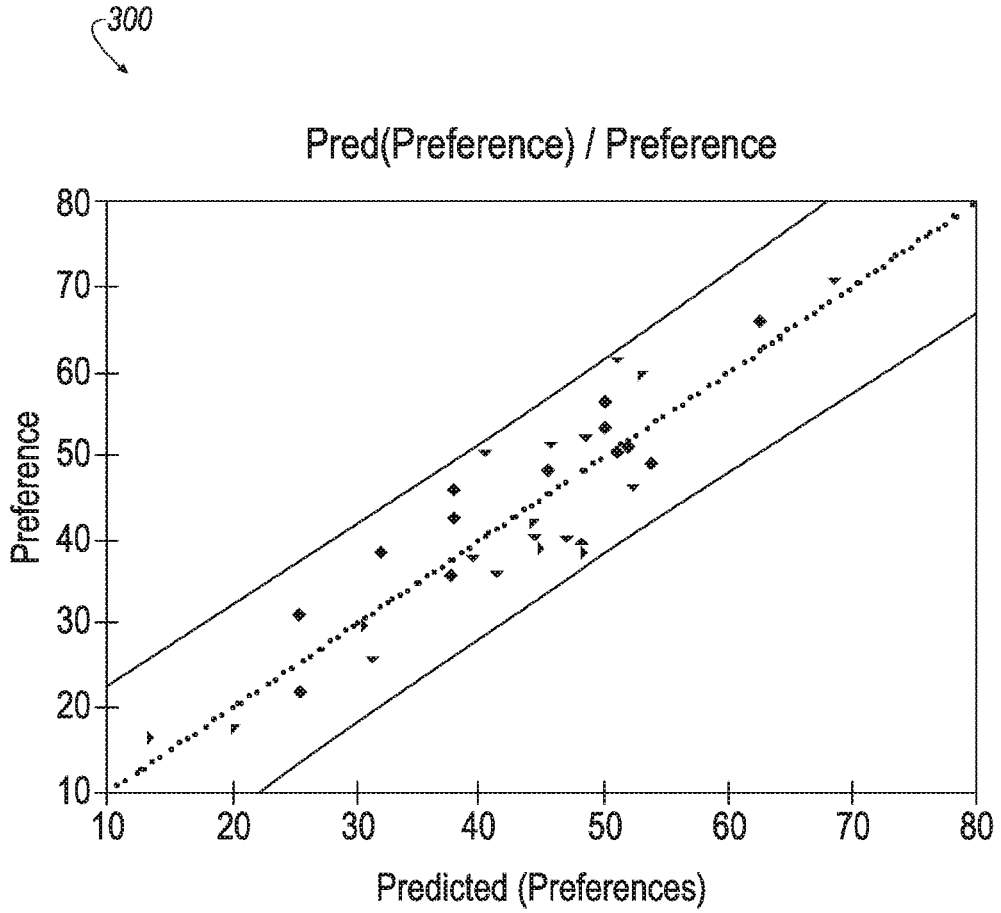
FIG. 3 illustrates an example scatterplot showing measured versus predicted preference ratings for a set of headphones.

FIG. 3 illustrates an example scatterplot 300 of predicted ratings 208 versus measured preference ratings of various different IE headphones. As shown, the scatterplot 300 includes measured versus predicted preference ratings for 32 different IE headphones 116. The standardized coefficients for the three independent variables are: SD=0.338, AS=−0.303, and ME=−0.324, which indicates that each variable is weighted approximately the same in the example. In an example, the measured preference ratings are taken from five controlled listening tests based on 71 trained and untrained listeners. Also, shown are the upper and lower 95% confidence intervals, meaning that there is only a 5% chance that the predicted ratings fall outside these confidence limits.

Figure 4:
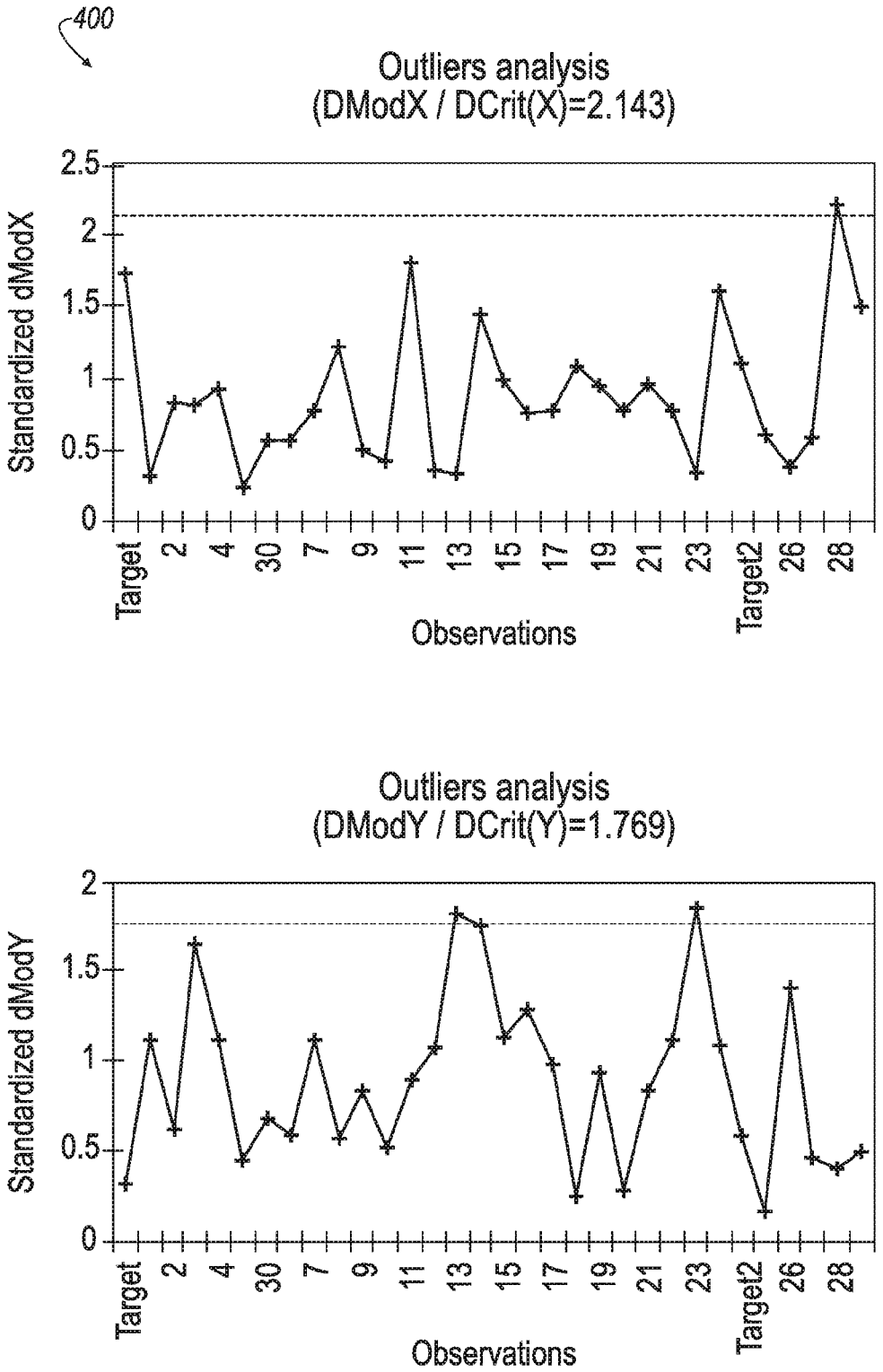
FIG. 4 illustrates example plots of results of an outlier analysis to determine which headphone models are not well explained by the model in terms of the independent variables and the preference rating.

FIG. 4 illustrates example plots 400 of results of an outlier analysis to determine which headphone models are not well explained by the model in terms of the independent variables and the preference rating. The first graph shows the distances of each observation to the model in the space of the x variables, identifying the outliers for the explanatory variables, while the second graph shows the distances of each observation to the model in the space of the y variables for the model defined by Equation 4. It can be seen from the graphs that observation 28 (headphone 28) is an outlier. The second graph shows the same information in the space of the y variable identifying outliers for the dependent variables (i.e., the preference rating). Notably, in the second graph the headphones 13 and 23 are both outliers.

Regarding validation of the model 140, the model 140 may be validated in various ways, two of which are discussed herein. In one example, model 140 may be validated by applying it to each of a set of listening tests performed using the headphones 116, and in another example by randomly removing a subset of headphones 116 from the original sample of headphones, recalculating the model 140 using the explanatory variables, and then applying the recalculated model 140 to the entire headphone 116 sample. This second approach may be repeated multiple times (e.g., 10 times in this example) after randomly removing a subset of the headphones 116 (in this example first six headphones 116 and then ten headphones 116 from the total sample).

Table 3 shows the Pearson correlation coefficient r, and the RMSE for each of the five listening tests reported in [1]. The statistics indicate that the model provides consistently accurate predictions with low errors across all five tests, suggesting that it is not too over-fitted.

TABLE 3

Goodness of fit statistics for model applied to the results from five listening tests

| Test | Correlation Coefficient r | RMSE |
|---|---|---|
| One | 0.96 | 4.95 |
| Two | 0.95 | 5.58 |
| Three | 0.89 | 6.35 |
| Four | 0.90 | 5.46 |
| Five | 0.98 | 3.81 |
| Six | 0.96 | 4.95 |

Table 4 shows the goodness of fit statistics for the second validation test where either 6 or 10 headphones were removed from the original sample of 29 headphones after which the model was recalculated and applied to the entire sample.

TABLE 4

Goodness of Fit Statistics for Validation of Mode

| Number of Headphones in Subset | Range of r value | Mean r value | Range of RSME value | Mean RSME |
|---|---|---|---|---|
| 6 | 0.87-0.96 | 0.91 | 4.4-6.1 | 5.5 |
| 10 | 0.83-0.95 | 0.90 | 4.4-6.1 | 5.5 |

While removing six versus ten headphones 116 from the sample produced slightly better predictions of headphone preferences, both produced relatively good predictions and low error when averaged over 10 validation tests. Thus, the model 140 seems to be relatively robust when applied to different subsets of headphones 116 from the sample.

Figure 5:
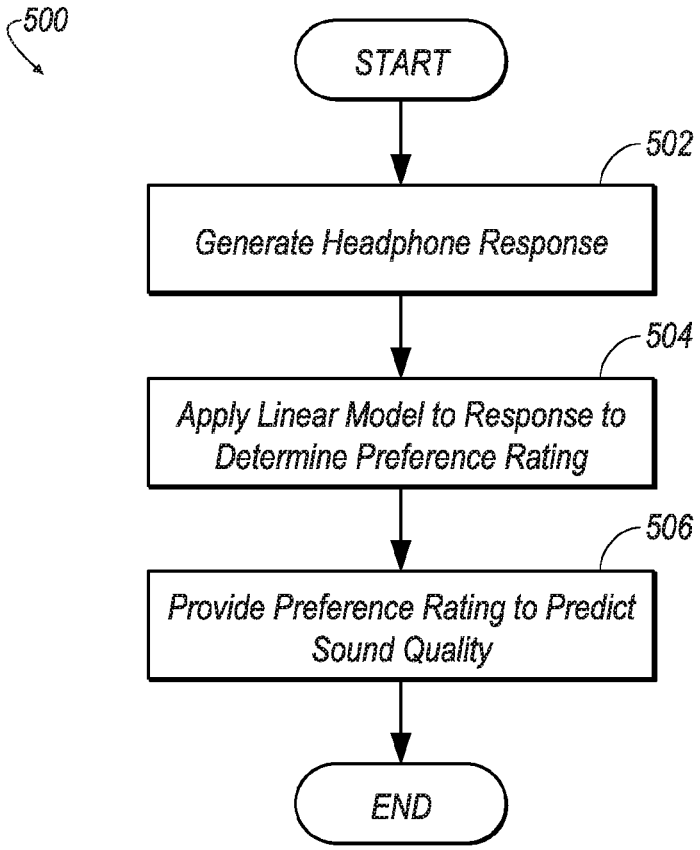
FIG. 5 illustrates an example process for predicting listener preference ratings for headphones.

FIG. 5 illustrates an example process 500 for predicting listener preference ratings for headphones. In an example, the process 500 may be performed using the computing device 102 of FIG. 1.

At 502, the computing device 102 captures a headphone response curve defining a frequency response of a headphone. In an example, for a new headphone 116 to be tested, frequency response of the left and right channels of the headphone are measured by the computing device 102 using a headphone coupler, e.g., from 20 Hz to 20 kHz in 48 log spaced points from 20 Hz to 20 kHz. An average magnitude response of the left and right channels may then be calculated. (In some examples, the exact number of points per octave (known as the frequency resolution) could be reduced, if necessary, or smoothed down to 1/12-octave to reduce data storage requirements or to better simulate frequency resolution of human perception.) A headphone response error curve (HREC) may then be calculated by the computing device 102 based on a difference in response between the headphone being tested and a target headphone response curve.

At 504, the computing device 102 applies the linear model 140 to the headphone response curve to determine a preference rating. In an example, three independent variables are calculated by the computing device 102 from the error response curve: the Mean Error (ME), the standard deviation (SD) and the absolute value of the Slope (AS), which is the slope of a logarithmic regression line that best fits the x and y values of the error response curve. The ME may be calculated from 40 Hz to 10 kHz. the SD and AS may be calculated from 20 Hz to 10 kHz. As shown in Equation 4, the predicted preference rating 208 of the headphone may, accordingly, be calculated using the linear regression model 206 where the three variables are weighted. Equation 5 shows an alternate example for a predicted preference rating 208 for AE/OE headphones, that uses only two of the variables.

At 506, the computing device 102 provides the preference rating to predict overall sound quality of the headphone 116 without listening tests. Accordingly, this system and method can be implemented as an algorithm included in the test software 138. The test software 138 may automatically calculate the sound quality or preference rating 208 after the measurement is performed. The test software 138 may, therefore, be used to make headphone design and testing more efficient and cost effective since the predicted preference rating 208 may largely eliminate the cost and time required to conduct controlled listening tests.

While an exemplary modularization of the computing device 102 is described herein, it should also be noted that elements of the computing device 102 may be incorporated into fewer units or may be combined in several units or even in one unit.

Figure 6:
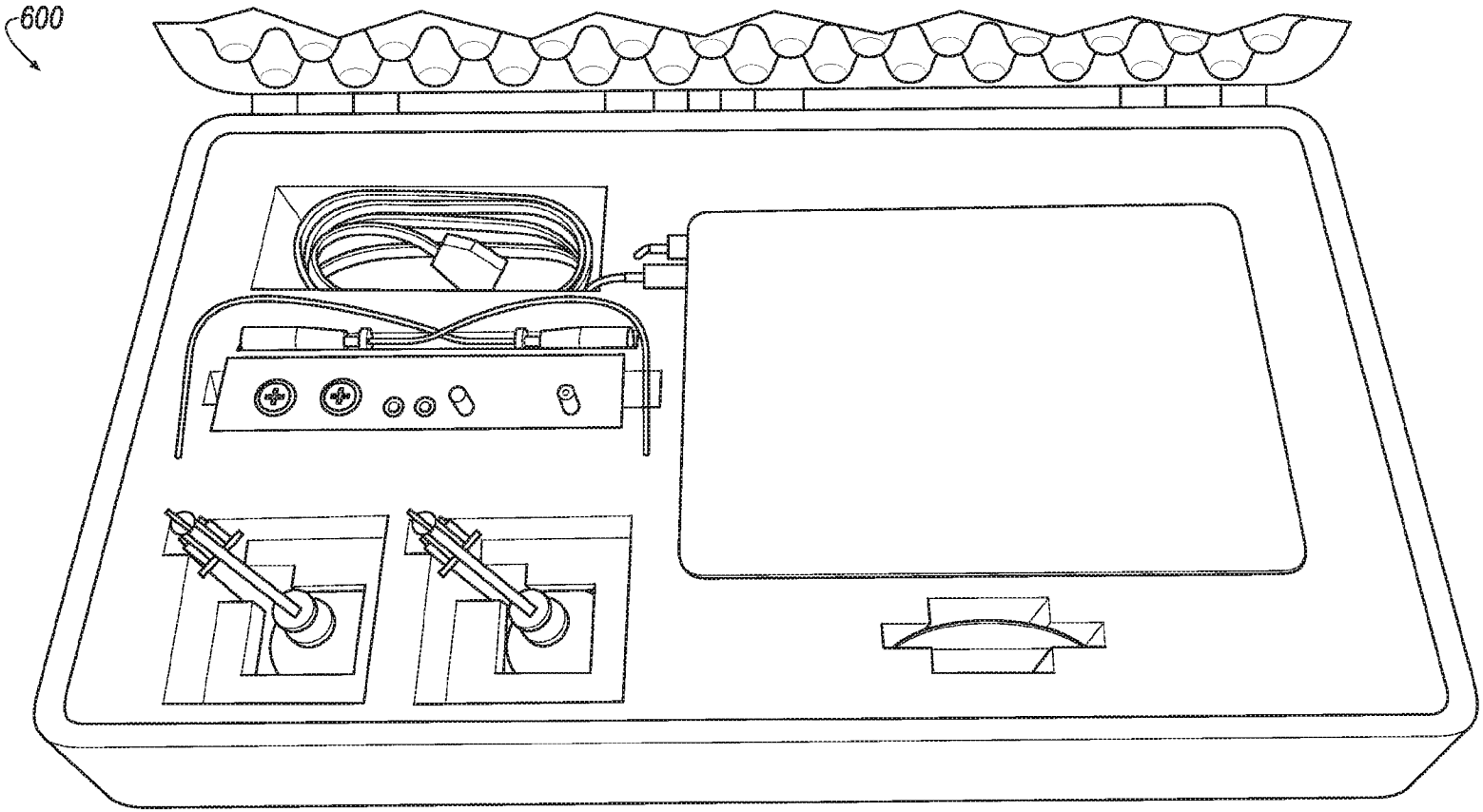
FIG. 6 illustrates an example one-click measurement system.

FIG. 6 shows an image of the measurement system in its rugged traveling case. The hardware includes: a laptop computer (e.g., a Macbook Air) with wireless mouse; a high quality at least 2-channel USB/FireWire sound card (e.g., RME Fire Face UCX as shown here); two GRAS 43 AC-Si ear simulators that meet IEC 60318-4; and G.R.A.S. AG0003 microphones/preamp with an adapter for CCP amplifier to XLR connector.

Figure 7:
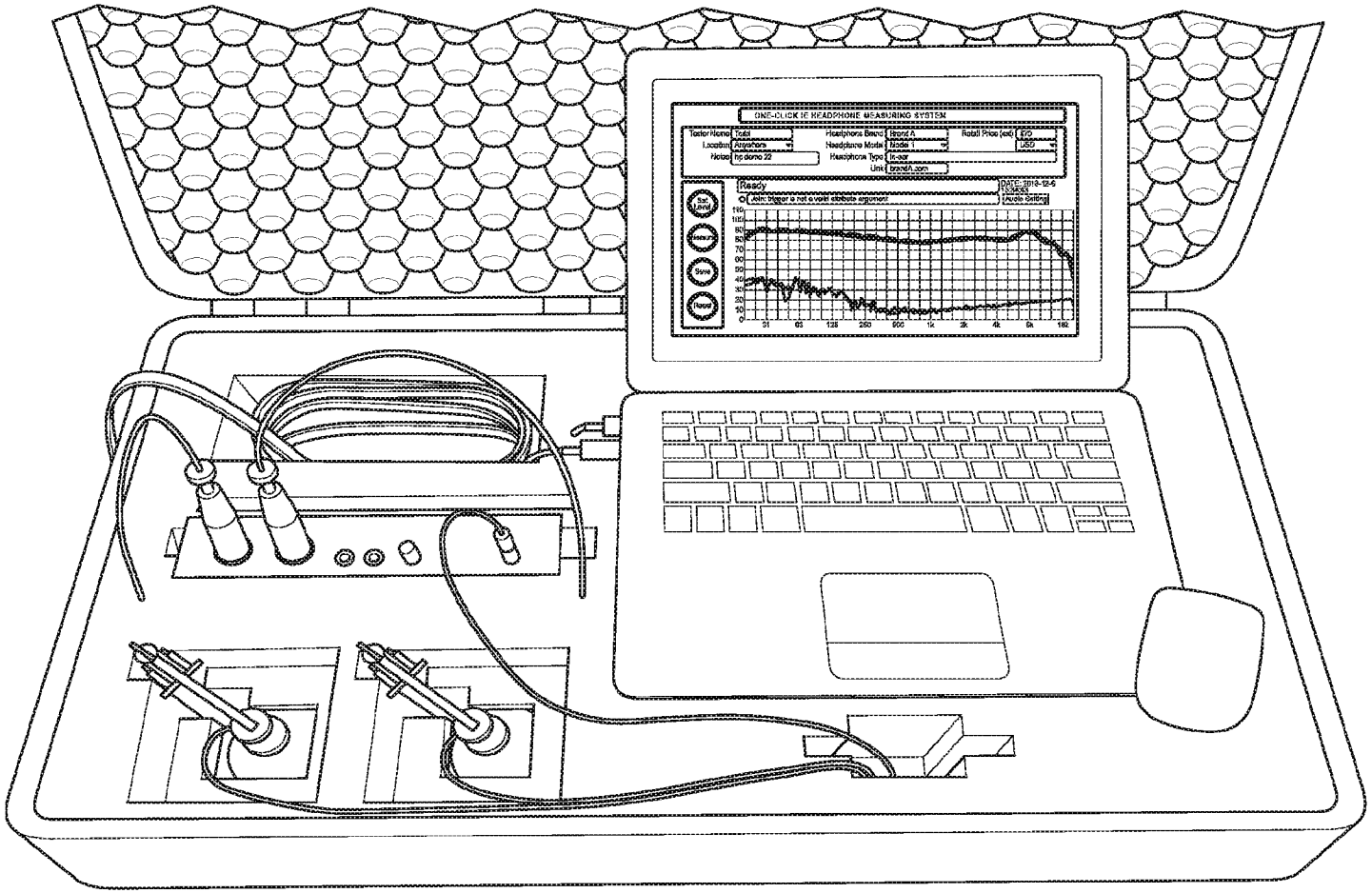
FIG. 7 illustrates an example one-click measurement system ready to perform a measurement.

FIG. 7 shows the hardware of the measurement system prepared for a measurement. The equipment and headphone measurement can be operated without removing it from the case while a USB fan keeps the soundcard cool. This minimizes the potential for damage by removing it from the case, and also simplifies proper connection of cables to the devices. Only the main power cord needs to be connected along with the XLR cables plugged into the front of the sound card.

Figure 8:
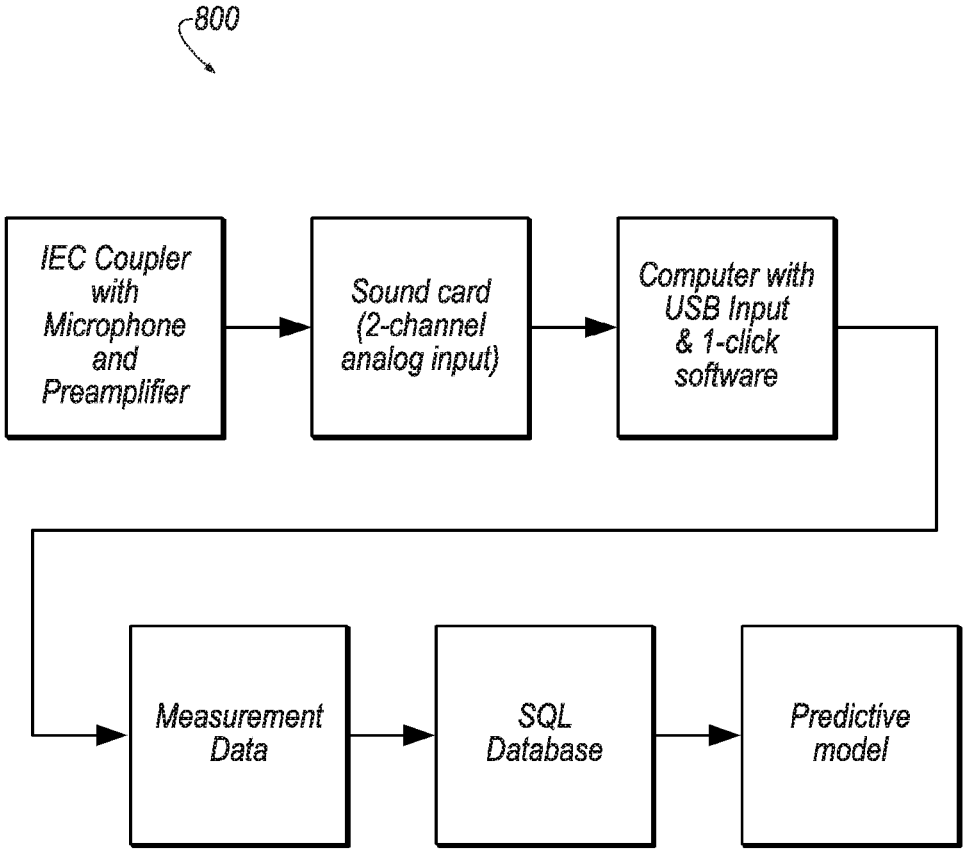
FIG. 8 illustrates an example block diagram of performing a one-click measurement.

FIG. 8 illustrates a block diagram that summarizes how the equipment is hooked up. The in-ear headphones are inserted into the IEC couplers, one each for the left and right channels. The output of the microphone/preamps is fed into the XLR inputs of the sound card located at the front. The USB digital output of the sound card is fed to the computer via USB. Once the computer is turned on, a screen is presented with four buttons.

The measurement software may be written in MAX/MSP. An example GUI of the application is shown in FIG. 8. An example process for taking a measurement is as follows. First, the user enters metadata or information about the headphone at the top of the screen including: tester name, location, notes, headphone brand, model, headphone type (IE, AE, OE), retail price, and an optional web link to product page. Next, there are four buttons on the user interface that may be used by an operator. These buttons may include a set level button, a measure button, a save button, and a reset button.

Pressing the set level button runs a repeating log sweep test signal allowing the user to adjust output level on the sound card to achieve a reference level (e.g. 90 dB). In some implementations, this step is automated.

Pressing the measure button runs a measurement with no test signal in order to document the background noise of the test setup (plotted as yellow curve) to determine if there is sufficient signal to noise amplitude. This check will also be automated in the future. Next, a log-based sweep test signal is fed to the headphones measuring simultaneously the frequency response of the left and right headphone channels. This is plotted as two curves (Red=right channel, Blue=left channel) on a log-based frequency response chart. The resolution of the measurement is 48 equally-log spaced points per octave from 20 Hz to 20 kHz.

Figure 9:
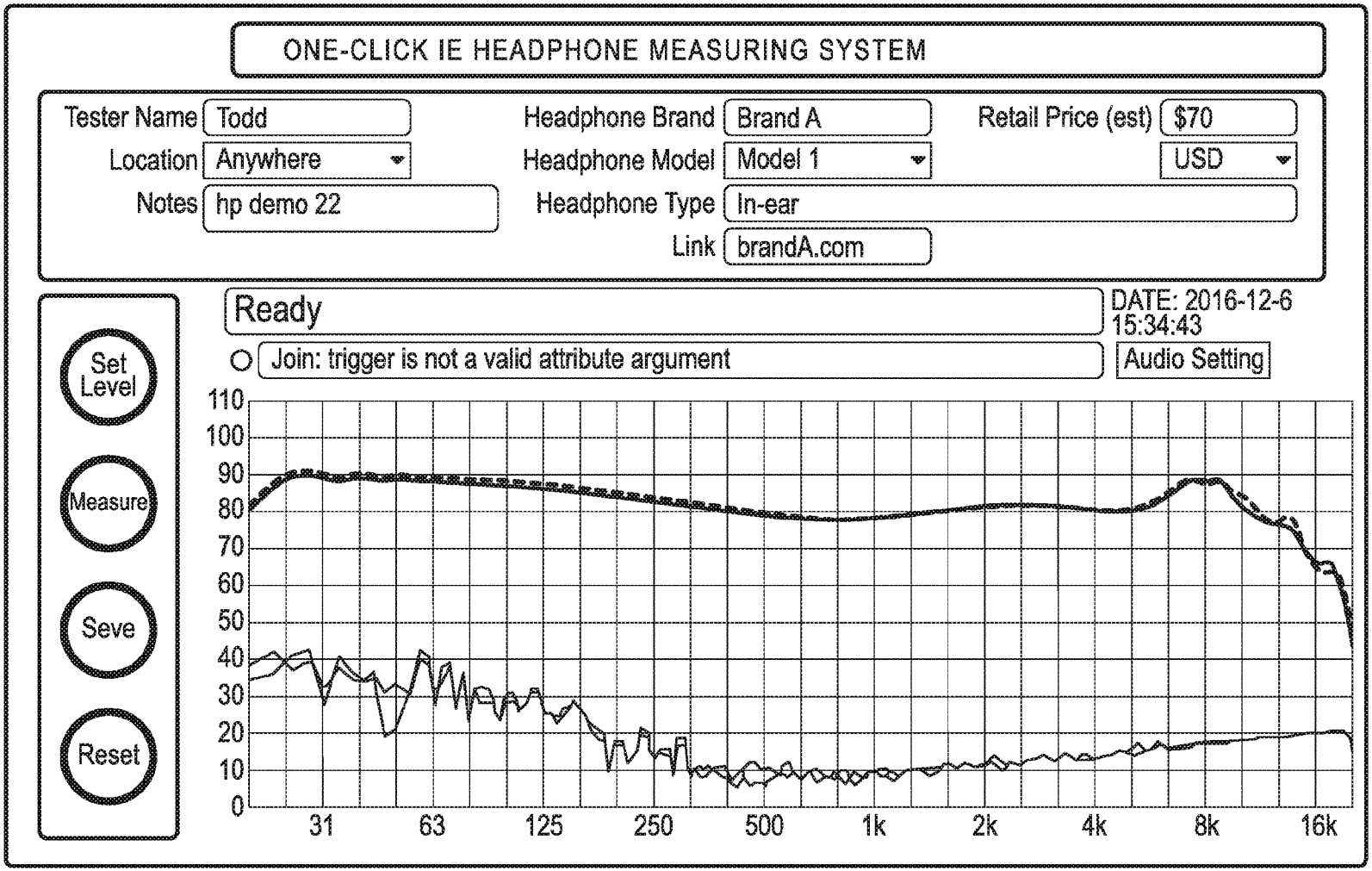
FIG. 9 illustrates an example screen user interface of the one-click headphone measurement system.

Pressing the save button automatically stores the measured magnitude and phase information in a MySQL database stored either on the laptop computer or a server connected to the Internet. Once the data is stored, a web browser is automatically launched within the application, which runs the predictive model and plots the information shown in FIG. 9.

Pressing the reset button automatically removes a previously measured plot from the screen if the measurement needs to be redone or there is no desire to store it.

The entire six-step process takes less than fifteen seconds, and only requires the operator to press three buttons. This can be reduced to one-button (measure) if the level settings and data storage are automated.

Figure 10:
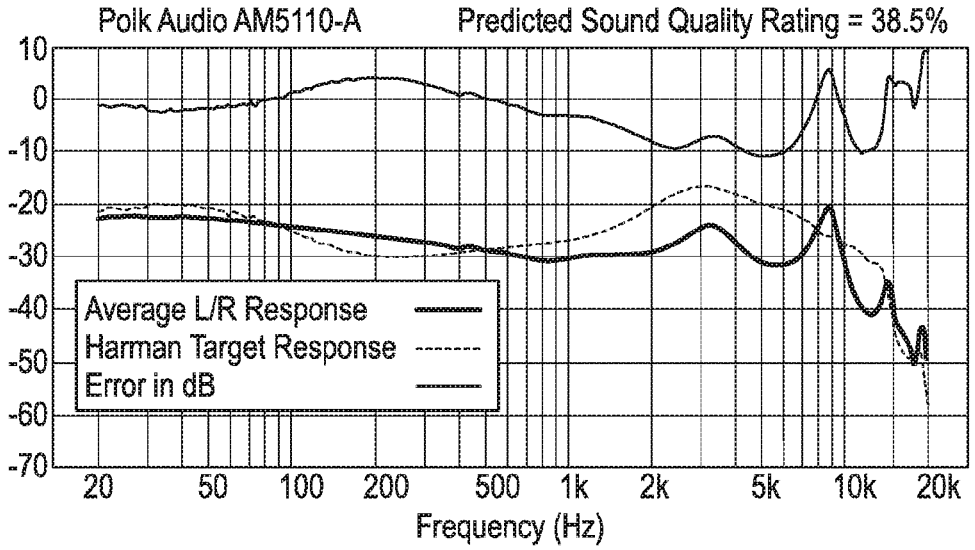
FIG. 10 illustrates an example user interface of a web application that calculates a predicted sound quality score of a headphone.

FIG. 10 shows the user interface of the web application that performs various operations relating to the testing of the headphones 116. These operations include loading the latest headphone measurement stored in the MySQL database. The web application may also plot the average left/right frequency response for the measured headphone on a Frequency (Hz) versus Level (dB) graph indicated by the blue curve). The web application may also plot a preferred target response (green curve) as a point of comparison. The levels of the two curves may be normalized at 500 Hz on the graph.

The web application may also calculate an error response curve (red curve) and plot the error curve at the top of the graph. This error curve represents a difference between the target response (green curve) and measured magnitude response of the headphone (blue curve). In an example, the error curve is normalized at 0 dB at 500 Hz and indicates the extent to which the headphone has too much or too little energy as a function of frequency relative to the target response curve.

The web application may also provide a predicted sound quality rating as shown (e.g. 38.5%) using the statistical model that is discussed herein.

At the top of the web application the user can select any stored measurement from the grid, which automatically plots the same information and calculates the predicted sound quality rating.

Additional features may be added to the web app. For instance, the web application may allow for an ability to select and plot curves and sound quality ratings of several headphones. Additionally, a numerical and/or graphic representation of the three model variables (ME, SD, and AS) used to calculate preference ratings may be provided. As another possibility, the web application may generate a warning for certain conditions that might indicate an error in the measurement or a set of headphones which are abnormal, such as distortion, noise, difference in left/right measurements, and so on. In another example, a Pass/Fail Flag may be implemented based on the predicted score of the headphone. This flag could then be an automated quality control (QC) criteria that would further reduce the training and skill of the operator. Or, the system may further implement an ability to audition a virtual version of the measured headphone or any headphone stored in the database by clicking on it. Several virtual headphones could be compared against each other as well as a virtual headphone equalized to the preferred target response curve. Yet further, the web application may implement an ability to search the database based on different metadata criteria and plot those results.

This disclosure describes a one-click measurement system specifically for in-ear headphones. However, the same principles, with some additional hardware, may be applied to around-ear and on-ear headphones. In an example, the ear simulators may be replaced with a GRAS 45 CA or binaural manikin (e.g. KEMAR, B&K HATS, or Head Acoustics) equipped with a leakage-accurate pinnae. The rest of the hardware (sound card, computer, and measurement software) would still apply.

Computing devices described herein generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for predicting listener preference ratings for headphones comprising:

a memory storing a linear model predicting a preference rating for headphones; and a processor programmed to:

display a user interface for measurement of headphones, the user interface including a set level control configured to provide a signal for adjusting a level of sound input for a sweep test to conform to a reference level, and a measure control to run a measurement without a test signal to document background noise and to perform the sweep test;

perform the sweep test of the headphone at the reference level accounting for the background noise to create a headphone response curve defining a frequency response of the headphone responsive to selection of a measure control of the user interface; and display a preference score for the headphone to the user interface computed using the linear model according to the sweep test.

2. The system of claim 1, wherein the processor is further programmed to automatically adjust the level of sound input to the headphone to conform to the reference level.

3. The system of claim 1, wherein the processor is further programmed to display, responsive to selection of the measure control to perform the sweep test, a graph of the frequency response of the headphone in comparison to a preferred headphone target response curve.

4. The system of claim 3, wherein the processor is further programmed to display, responsive to selection of the measure control to perform the sweep test, an error between the frequency response of the headphone and the preferred headphone target response curve.

5. The system of claim 1, wherein the frequency response of the headphone is displayed as an average of left and right channels of the headphone.

6. The system of claim 1, wherein the frequency response of the headphone is displayed as left and right channels of the headphone.

7. The system of claim 1, wherein the processor is further programmed to:

provide a control via the user interface to receive selection of whether the headphones are in-ear headphone or over-the-ear headphones;

responsive to selection of in-ear headphones from the control, utilize a linear model for in-ear headphones and a preferred headphone target response curve for in-ear headphones; and responsive to selection of over-the-ear headphones from the control, utilize a linear model for over-the-ear headphones and a preferred headphone target response curve for over-the-ear.

8. The system of claim 1, wherein the processor is further programmed to include, in the user interface, a representation of model variables of the linear model used to calculate preference rating.

9. The system of claim 8, wherein the processor is further programmed to calculate a headphone response error curve (HREC) based on a difference in response between the headphone response curve and a target headphone response curve, wherein the linear model is developed using independent variables including mean error (ME) of the headphones response curve to the target headphone response curve, standard deviation (SD) of error of the HREC, and absolute value of a slope (AS) of a logarithmic regression line that best fits y and x values defined in the HREC, and the representation of the model variables included in the user interface includes a representation of ME, SD, and AS.

10. The system of claim 1, wherein the processor is further programmed to generate a warning in the user interface responsive to occurrence of one or more of:

distortion identified in the frequency response of the headphone;

unexpected noise identified in the frequency response of the headphone; or a difference in measurement of the frequency response of the headphone between left and right channels of the headphone.

11. The system of claim 1, wherein the processor is further programmed to display, in the user interface a Pass/Fail indication identifying whether the headphone passed or failed testing according to the preference score.

12. The system of claim 1, wherein the preference score is a 100-point scale from 1 to 100.

13. A method comprising:

displaying a user interface for measurement of headphones;

receiving, via the user interface, information about a headphone to be tested;

responsive to selection of a set level control, providing a signal for adjusting a level of sound input for a sweep test to conform to a reference level;

responsive to selection of a measure control of the user interface, performing the sweep test of the headphone at the reference level to create a headphone response curve defining a frequency response of the headphone; and displaying test results for the headphone to the user interface, the test results including a preference score for the headphone computed using a linear model and the headphone response curve.

14. The method of claim 13, wherein the information about the headphone to be tested includes a brand of the headphone, a model of the headphone, and whether the headphone is an in-ear headphone or an over-the-ear headphone.

15. The method of claim 13, further comprising storing the test results for the headphone to a database indexed according to the information about the headphone.

16. The method of claim 15, further comprising retrieving the test results for the headphone from the database according to the information about the headphone.

17. The method of claim 13, wherein the displayed test results include one or more of:

a graph of the frequency response of the headphone in comparison to a preferred headphone target response curve;

an error between the frequency response of the headphone and the preferred headphone target response curve;

a Pass/Fail indication identifying whether the headphone passed or failed testing according to the preference score; or a representation of model variables of the linear model used to calculate preference rating.

18. A non-transitory computer-readable medium comprising instructions that, when executed by a processor of a headphone measuring system, cause the headphone measuring system to:

display a user interface for measurement of headphones;

responsive to selection of a set level control, providing a signal for adjusting a level of sound input for a sweep test to conform to a reference level;

responsive to selection of a measure control of the user interface, perform the sweep test of the headphone at the reference level to create a headphone response curve defining a frequency response of the headphone; and display test results for the headphone to the user interface, the test results including a preference score for the headphone computed using a linear model and the headphone response curve, the linear model being developed using independent variables including mean error (ME) of the headphones response curve to a target headphone response curve, standard deviation (SD) of error of a headphone response error curve (HREC) computed based on a difference in response between the headphone response curve and the target headphone response curve, and absolute value of a slope (AS) of a logarithmic regression line of the HREC.

19. The medium of claim 18, further comprising instructions that, when executed by a processor of a headphone measuring system, cause the headphone measuring system to:

receive, via the user interface, information about a headphone to be tested; and store the test results for the headphone to a database indexed according to the information about the headphone.

20. The medium of claim 19, further comprising instructions that, when executed by a processor of a headphone measuring system, cause the headphone measuring system to retrieve the test results for the headphone from the database according to the information about the headphone.

* * * * *